US006056454A

United States Patent [19]

Plumley et al.

[11] Patent Number: 6,056,454

[45] Date of Patent: May 2, 2000

[54] METHOD AND APPARATUS FOR PRINTING ON A CONTINUOUSLY MOVING SHEET OF WORK MATERIAL

[75] Inventors: A. Bruce Plumley, Middletown; Darryl Colburn Stein, Andover, both of Conn.

[73] Assignee: Gerber Technology, Inc., Tolland, Conn.

[21] Appl. No.: 09/166,314

[22] Filed: Oct. 5, 1998

[51] Int. Cl.[7] ..... B41J 2/32; B41J 2/01

[52] U.S. Cl. ..... 400/120.16; 400/120.17; 400/611; 347/37

[58] Field of Search ..... 400/611, 120.16, 400/120.17; 347/37, 104, 218

[56] References Cited

U.S. PATENT DOCUMENTS

| | | | |
|---|---|---|---|
| 3,742,846 | 7/1973 | Knappe | 101/93.05 |
| 4,839,741 | 6/1989 | Wilson | 358/404 |
| 5,838,346 | 11/1998 | Stemmle, Sr. | 347/37 |

FOREIGN PATENT DOCUMENTS

| | | | |
|---|---|---|---|
| 333609 | 9/1989 | European Pat. Off. | 347/37 |
| 0 881 820 A2 | 2/1998 | European Pat. Off. . | |
| 61-141567 | 6/1986 | Japan . | |
| 2-292047 | 12/1990 | Japan . | |
| 6-71964 | 3/1994 | Japan . | |
| 6-198867 | 7/1994 | Japan | 347/37 |

OTHER PUBLICATIONS

Journal Article of Dietl et al., Date Jul./Aug. '90, Country USA.

*Primary Examiner*—John S. Hilten
*Assistant Examiner*—Daniel J. Colilla
*Attorney, Agent, or Firm*—McCormick, Paulding & Huber LLP

[57] ABSTRACT

In an apparatus for printing on a continuously moving sheet of work material, a frame is provided and defines a work supporting surface over which a sheet of work material is advanced in a first coordinate direction longitudinally of itself. An elongated support is mounted to the frame and extends transversely across the work supporting surface. A print head is mounted to the elongated support and is movable across the support, as well as between a forward and rearward position. During operation, as the work material is continuously advanced through the apparatus, the print head traverses the support and simultaneously moves between the forward and rearward positions, such that the print head has a component of speed in the first coordinate direction approximately equal to the rate at which the work material is advanced. This causes the print head to print successive lineal portions of a graphic oriented approximately perpendicular to the first coordinate direction while the work material is continuously advanced.

20 Claims, 3 Drawing Sheets

METHOD AND APPARATUS FOR PRINTING ON A CONTINUOUSLY MOVING SHEET OF WORK MATERIAL

FIELD OF THE INVENTION

The present invention relates generally to printing on sheet-type work materials using inkjet, dot matrix, thermal, or like print heads, and deals more particularly with an apparatus and method for printing on a continuously fed sheet of work material, whereby the print head traverses the width of the work material along a path selectively oriented at an angle relative to the longitudinal axis of the work material, such that the component of the print head speed in the direction defined by the longitudinal axis of the work material equals the speed at which the work material is advanced in that direction. This allows the work material to be printed along lines approximately perpendicular to the material's longitudinal axis.

BACKGROUND OF THE INVENTION

The present invention is directed to an apparatus and method for printing a graphic onto a continuously moving sheet of work material, and will be described herein as applied to such use.

In known printers, a single print head is usually mounted on a frame for movement transversely across a piece of sheet-type work material. In many instances the print head includes a print cartridge having an ink reservoir and a number of discrete inkjets arranged in a matrix-like pattern adjacent to the media to be printed. This matrix-like pattern of inkjets is referred to by those skilled in the pertinent art as an array.

Typically, a line of a graphic is printed onto the work material by causing the print head to traverse the work material while the work material is stationary. As the print head moves, the inkjets spray appropriately colored ink onto the work material in accordance with commands issued from a controller. The work material is then incrementally advanced an amount preferably equal to the height of the array of inkjets, and the print head makes another pass across the work material. This process of incrementally advancing the work material and printing, is continued until the entire graphic is printed onto the work material.

A problem associated with printing a graphic in this manner is that due to the incremental indexing and stopping of the sheet material advancement, the process of printing a large graphic becomes very time consuming, and expensive. In addition, in large printing applications, it is often necessary to accelerate and decelerate large rollers of sheet material.

Moreover, the discrete motion of the sheet material as it is advanced can cause slight misalignments, that in turn generate inaccuracies in the printed graphic. In addition, after a line is printed the work material must be advanced an amount equivalent to the height of the array of inkjets defined by the print cartridge. Any deviation will either cause overlap or gaps between successive printed lines depending on whether the work material advanced too far or too little.

Based on the foregoing, it is the general object of the present invention to provide a plotter that overcomes the above-described problems and drawbacks present in the prior art.

It is a more specific object of the present invention to provide a printer that can print a graphic onto a piece of sheet-type work material that is continuously fed through the printer without having to stop the advancement of the work material.

SUMMARY OF THE INVENTION

The present invention is directed to an apparatus for printing on a continuously moving sheet of work material that includes a frame defining a work supporting surface, as well as means for continuously feeding the work material in a first coordinate direction longitudinal of itself, over the work supporting surface. An elongated support having first and second ends is coupled to the frame and extends transversely across the work supporting surface. At least one print head is coupled to the support for movement between the first and second ends.

In an embodiment of the present invention includes means for selectively and continuously moving the print head across the elongated support between the first and second ends, as well as means for progressively moving the print head between a forward and rearward position as the print head moves along the support between the first and second ends are included. A controller having graphical data stored therein in a machine readable format and in communication with the apparatus is also provided. The controller issues commands to the apparatus in accordance with the stored data to control the positional relationship of the print head relative to the support and the work material being advanced through the apparatus. During operation, the combined motion of the print head and the work material, in accordance with the commands issued from the controller, causes the print head to print successive lineal portions of the graphic, oriented approximately perpendicular to the first coordinate direction.

Preferably, the print head includes a plurality of spaced-apart rows of discrete print elements, such as ink jets arranged in a matrix-like array having a given height, each for printing a series of dots or pixels of a given height onto the work material. During operation, when the print head reaches either the first or second end of the elongated support, the above-described means for progressively moving the print head cause it to move in a direction opposite to the first coordinate direction, an amount equal to the width of the printed line less the distance moved by the work material during the movement of the print head.

In another embodiment of the present invention the portion of the array of print elements are selectively actuated and the print head moves between the first and second ends of the support. Accordingly, during operation, the active portions of the array of print elements shifts along the first coordinate direction as the head traverses the moving sheet material. Accordingly, the shifting active portions of the array of print elements in combination with the motion of the material in the first coordinate direction cause the print head to print a lineal portion of a graphic onto the work material in response to commands issued from the controller.

The means for selectively and continuously moving the print head between the first and second ends of the elongated support, can take the form of a belt mounted on a pair of sprockets that in turn are rotatably mounted to the support. One sprocket in the pair is located adjacent to the first end of the support, and the other sprocket in the pair is located adjacent to the second end of the support. In addition, the means for progressively moving the print head between a retracted and extended position can take the form of a bracket attached to the belt with the print head slidably mounted on the bracket.

An actuator is also mounted on the bracket and is engaged with the print head. Accordingly, rotation of the sprockets causes the belt to move the bracket between the first and second ends of the support, while the actuator moves the print head between the forward and rearward position, in response to commands issued from the controller. Alternatively, the belt can be mounted at an angle relative to the work material, thereby eliminating the need for the print to move between the above-described retracted and extended positions.

In another embodiment of the present invention, the elongated support is pivotally coupled to the frame for selective movement between first and second angles. Preferably, the second angle is approximately equal and opposite to the first angle. In operation, the print head is slidably coupled to, and moves along the support between the first and second ends. The support pivots between the first and second angles in response to commands issued from the controller, enabling the print head to continuously print successive lineal portions of a graphic, oriented approximately perpendicular to the first coordinate direction.

In still another embodiment of the present invention, the path traversed by the print head is figure-8-shaped and is defined by a path coupled to an underside of the elongated support. The path includes a first segment oriented along a first angle and a second segment oriented along a second angle approximately equal and opposite to the first angle. Preferably, the second segment crosses the first segment at a point approximately midway across the work material being fed through the apparatus.

In addition to the foregoing, the present invention can also employ a plurality of staggered print heads, slidably coupled to the elongated support and spaced a predetermined distance away from the next successive print head. During operation, each of the print heads prints a lineal portion of the graphic along a line approximately perpendicular to the first coordinate direction as the print head traverses a respective one of the first and second segments, thereby printing several lines in a single pass.

The present invention also resides in a method for printing a graphic onto a continuously moving sheet of work material whereby an apparatus as described above is provided, as is a sheet-type work material. The work material is moved through the apparatus in the first coordinate direction, at a predetermined rate. The print head, in response to commands issued from the controller traverses the elongated support between the first and second ends. Concomitant with this movement, the print head is also moved between the forward and rearward positions, such that the movement of the print head has a component of speed in the first coordinate direction approximately equal to the rate at which the work material is being advanced. While the print head is being moved, a lineal portion of a graphic is printed onto the work material and is oriented approximately perpendicular to the first coordinate direction.

Upon reaching either of the first or second ends, the print head is moved in a direction opposite to the first coordinate direction an amount approximately equal to the width of the printed line, less the distance the work material was advanced during the print head's motion.

DETAILED DESCRIPTION OF THE PREFERRED EMBODIMENTS

Figure 1:
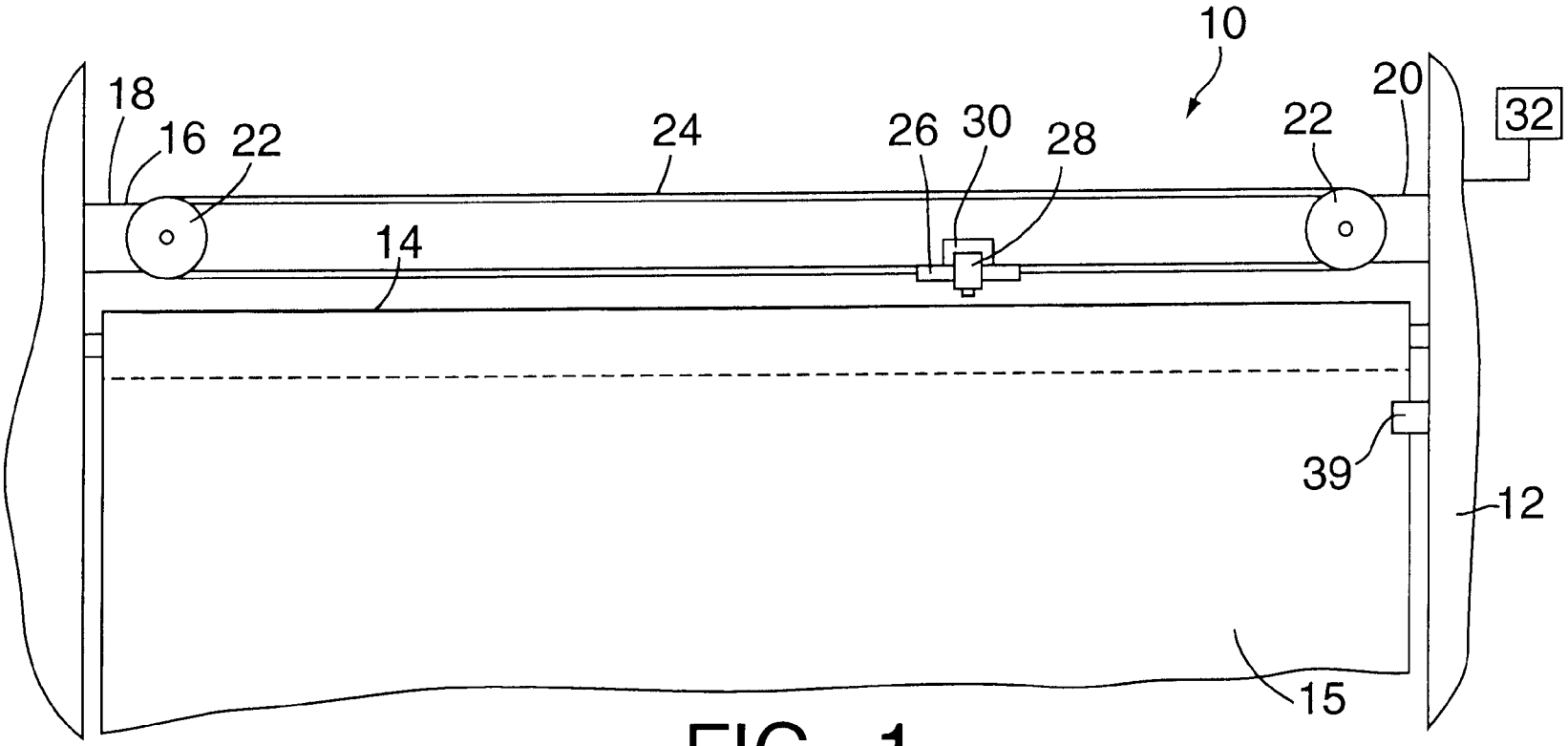
FIG. 1 is a schematic illustration of the apparatus of the present invention.

As shown in FIG. 1 a plotter embodying the apparatus of the present invention is generally designated by the reference numeral 10, and includes a frame 12 that defines a work supporting surface 14, shown in the illustrated embodiment as a roller mounted for rotation to the frame. A sheet of work material 15 overlies the work supporting surface 14 and is continuously advanced in a first coordinate direction longitudinally of itself by suitable means (not shown), such as but not limited to a friction or sprocket drive. An elongated support 16 extends transversely across the work supporting surface 14 and is attached to the frame 12. A pair of sprockets 22 are rotatably mounted to the frame 12 and a belt 24 is mounted on the sprockets. At least one of the sprockets is driven by a suitable drive, such as, but not limited to a servo or a stepper motor (not shown). A bracket 26 is attached to the belt 24 adjacent to the work supporting surface 14. A print head 28, explained in detail herein-after is slidably mounted on the bracket 26 positioned above the work material 15.

An actuator 30, such as a stepper motor, or servo is also mounted to the bracket 26 and engages the print head 28. In addition, a controller 32, having data corresponding to a graphic to be printed onto the work material 15 stored therein in machine readable format is provided and issues commands to the apparatus 10. While the actuator 30 has been described as being a stepper motor, or a servo, the present invention is not limited in this regard as other actuators known to those skilled in the pertinent art may be substituted. For example, a mechanical cam, a hydraulic or pneumatic cylinder coupled to a servo valve could be employed without departing from the broader aspects of the present invention.

Figure 2:
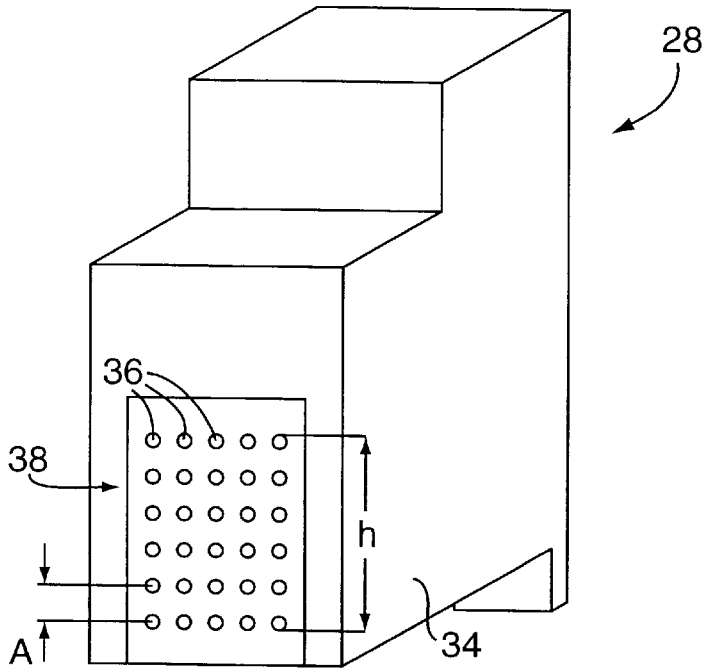
FIG. 2 is a perspective view of the print head showing a plurality of discrete ink jets arranged in an array.

As shown in FIG. 2, the print head 28 includes an ink reservoir 34 and a plurality of rows of discrete printing elements shown in the illustrated embodiment as ink jets 36 spaced apart by a distance "A" and arranged in a matrix-like array 38 defining a height designated in FIG. 2 by "h". The ink jets 36 are in fluid communication with the reservoir 34 and can be selectively actuated in response to commands issued from the controller, to print onto the work material 15, FIG. 1. While the array illustrated in FIG. 2 is rectangular, the present invention is not limited in this regard as other geometric array configuration, such as staggered arrays, can be substituted without departing from the broader aspects of the present invention.

During operation, the work material 15 is continuously advanced through the apparatus 10 longitudinal of itself in the first coordinate direction. The belt 24 is driven by the sprockets 22 in response to commands issued from the controller 32, thereby causing the print head to traverse the work material 15 between the first and second ends, 18 and 20 respectively, of the elongated support 16. Simultaneously, the actuator 30 moves the print head 20 between a forward and rearward position such that the motion of the print head has a component of speed in the first coordinate direction approximately equal to the rate at which the work material 15 is advanced through the apparatus 10. As the print head 28 traverses the work material 15, it prints a lineal portion of a graphic onto the work material in response to commands issued from the controller 32. The combined motion of the print head 28 and the work material 15, causes the print head to follow and print a line approximately perpendicular to the first coordinate direction.

When the print head 28 reaches the first or second end, 18 or 20 respectively, of the support 16, the actuator 30, in response to commands issued from the controller 32 causes the print head to move from the forward to the rearward position or vice versa in a direction opposite to the first coordinate direction by an amount approximately equal to the width of the line just printed. Accordingly, the distance moved by the print head is equal to the width of the line just printed, less the distance moved by the work material while the print head is moving. In this manner the print head 28 can print successive lineal portions of the graphic without any undesired gaps between them while the work material is continuously advanced.

In another embodiment of the present invention, portions of the array 38 of print elements 36 can be sequentially activated as the print head 28 traverses the work material. In this manner, the sequential activation of the print elements 36 can be such as to mimic the above-described movement of the print head 28 between the rearward and forward positions, thereby printing lineal portions of a graphic without any undesirable gaps.

The present invention can also include a feed back sensor 39 mounted to the apparatus 10 for sensing the speed at which the work material is being advanced. During operation, the feedback sensor 39 generates and sends signals to the controller corresponding to the speed at which the work material is being advanced. The speed at which the print head 28 prints, or traverses the elongated support and thereby the work material is then adjusted, in response to commands issued from the controller, to compensate for any variations in the speed at which the work material is being advanced. In addition, the rate at which the work material is advanced can also be adjusted to compensate for any delays in communications between the controller and the print head.

Figure 3:
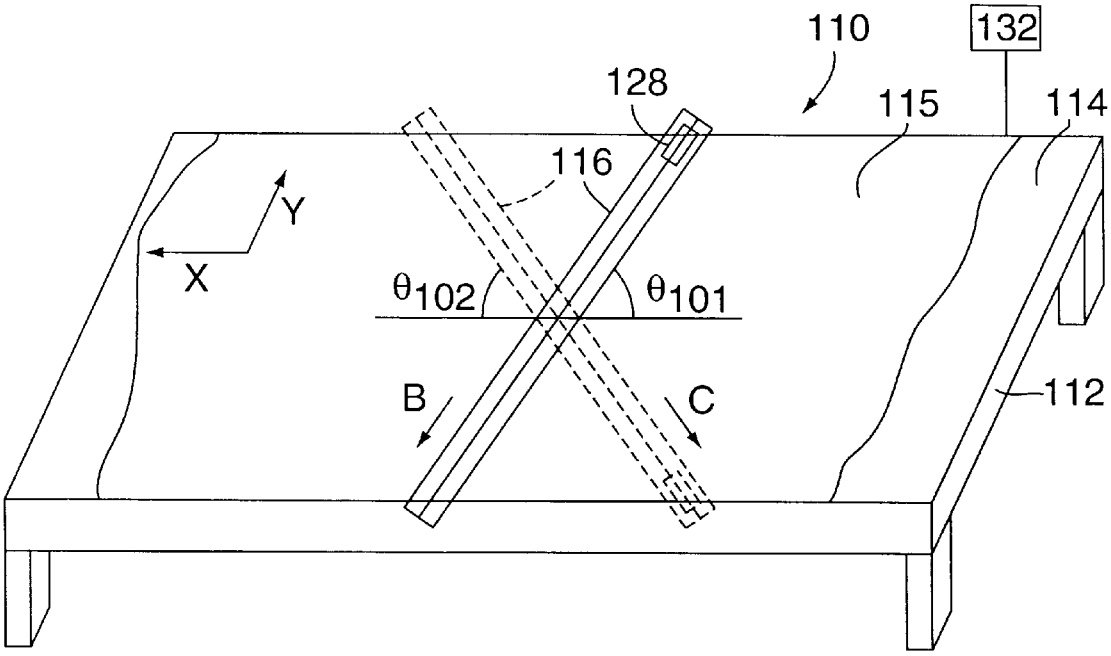
FIG. 3 is a perspective view of an embodiment of the apparatus of FIG. 1 showing a support pivotally coupled to the frame for guiding the print head.

An embodiment of the apparatus of the present invention, shown in FIG. 3, is generally designated by the reference numeral 110. The apparatus 110 is similar in many respects to the apparatus 10 described above, and therefore like reference numerals preceded by the number 1 are used to indicate like elements. In this embodiment, the elongated support 116 is pivotally mounted to the frame 112 for movement between a first angle $\theta_{101}$ measured relative to the first coordinate direction designated as X in FIG. 3, and a second angle $\theta_{102}$ (shown in phantom) approximately equal and opposite in magnitude to the first angle. The support 116 is moved in response to commands issued from the controller by suitable means (not shown), such as, but not limited to a stepper motor, or servo.

The print head 128 is slidably and pivotally mounted on the support for movement in a first direction indicated by the arrow B when the support 118 is oriented along the first angle $\theta_{101}$, and in a second direction generally indicated by C when the support (shown in phantom) is oriented along the second angle $\theta_{102}$.

During operation, as the work material is continuously advanced in the first coordinate direction X, the support 118 is pivoted into position along the angle $\theta_{102}$ in response to commands issued by the controller. Next, the print head 128 also pivots relative to the support 118, to properly orient the print head, and is moved transversely across the work material 115 in the first direction B. Commands issued from the controller 132 regulate the speed of the print head 128, such that the component of the speed of the print head in the first coordinate direction X approximately equals the speed at which the work material 115 is advanced over the work supporting surface 114. This in turn causes the print head 128 to print a lineal portion of the graphic along a first line approximately perpendicular to the first coordinate direction.

Once the first line has been printed, the support 116 is pivoted into position along the angle $\theta_{102}$ in response to commands issued by the controller. The print head 128 pivots relative to the support 118 and moves across the work material 115 in the second direction C, generally opposite to the first direction. Similar to the movement of the print head 128 in the first direction, commands issued from the controller regulate the speed of the print head such that the component of the print head speed in the first coordinate direction X approximately equals the speed at which the work material 115 is advanced over the work supporting surface 114. This causes the print head 128 to print a lineal portion of the graphic along a second line approximately parallel to the first line. In addition to controlling the speed of the print head 128 as it traverses the work material 115 in the first and second directions, B and C respectively, commands issued from the controller also adjust the angles $\theta_{102}$ and $\theta_{102}$, to insure that the graphic is printed approximately perpendicular to the first coordinate direction X. While the apparatus 110 has been shown and described as including a single print head 128, the invention is not limited in this regard as a plurality of print heads can be coupled for movement to the support, with each print head being staggered a predetermined distance away from the next successive print head.

Figure 4:
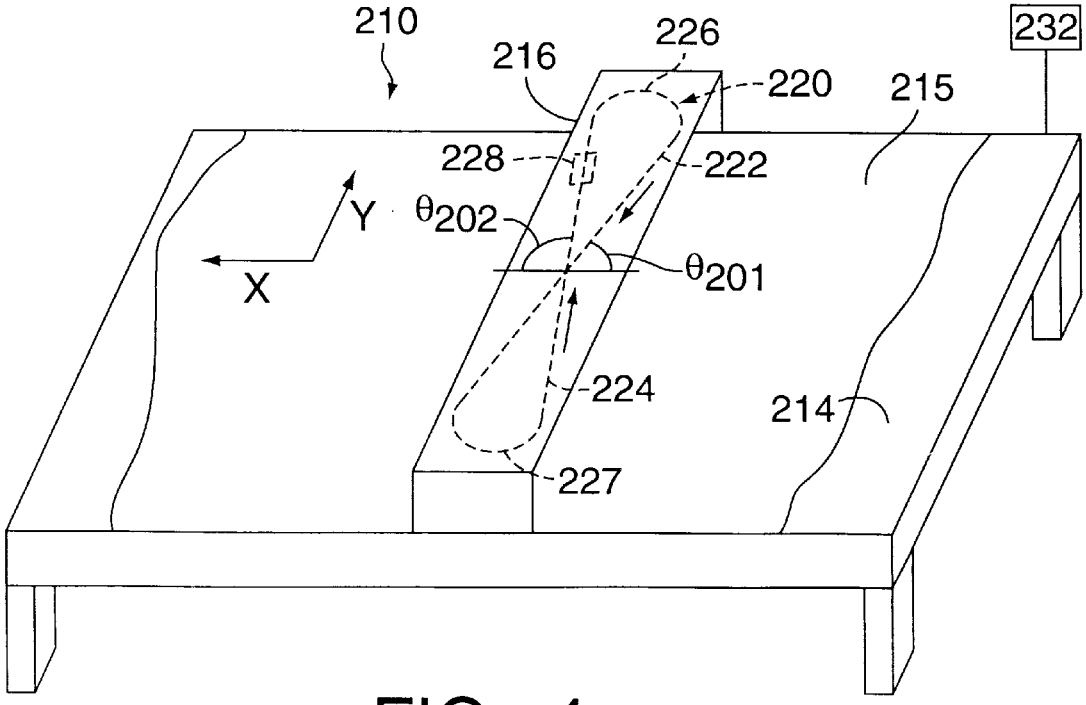
FIG. 4 is a perspective view of another embodiment of the apparatus of FIG. 1 showing a support defining a figure-8-shaped path for guiding the print head.

Another embodiment of the apparatus of the present invention, shown in FIG. 4, is generally designated by the reference numeral 210. The apparatus 210 is similar in many respects to the apparatus 10 described above, and therefore like reference numerals preceded by the number 2 are used to indicate like elements. In this embodiment, the support 216 includes a figure-8-shaped path (shown in phantom) generally designated by the reference numeral 220 mounted to an underside of the support. The figure-8-shaped path 220 includes a first segment 222 extending transversely across the work material 215 and oriented at an angle $\theta_{201}$ relative to the first coordinate direction X, and a second segment 224, also extending transversely across the work material 215 and oriented at a second angle $\theta_{202}$ relative to the first coordinate direction. The second segment 224 crosses the first segment 222 at a point approximately midway across the work material 215. As shown in FIG. 4, the first and second segments, 222 and 224 respectively, are joined at there end points by arcuate segments 226 and 227 to complete the figure-8. The print head 228 is coupled to and continuously traces the figure-8-shaped path 220.

During operation, as the work material 215 is advanced in the first coordinate direction X, the print head 216 traces the figure-8-shaped path 220. Similarly to the above-described embodiments of the present invention, the speed at which the print head 228 moves along the first and second segments, 222 and 224 respectively, is regulated by the controller such that the component of print head speed in the first coordinate direction X equals the speed at which the work material 215 is advanced over the work support surface 214. Accordingly, the print head 228 will print successive lineal portions of a graphic oriented approximately perpendicular to the first coordinate direction, in response to commands issued from the controller 232.

The arcuate segments 226 and 227 each extend across the support 216 a distance approximately equal to the height "h" of the array, as shown in FIG. 2. In order to avoid gaps in the printed graphic, the print head must traverse the arcuate segments 226 and 227 in the time it takes for the work material 215 to advance a distance approximately equal to the spacing "a", FIG. 2, between adjacent rows of ink jets 36 in the array 38. While the path has been shown and described as being figure-8-shaped, the present invention is not limited in this regard as other path shapes, such as, but not limited to oval, can be substituted without departing from the broader aspects of the present invention.

Figure 5:
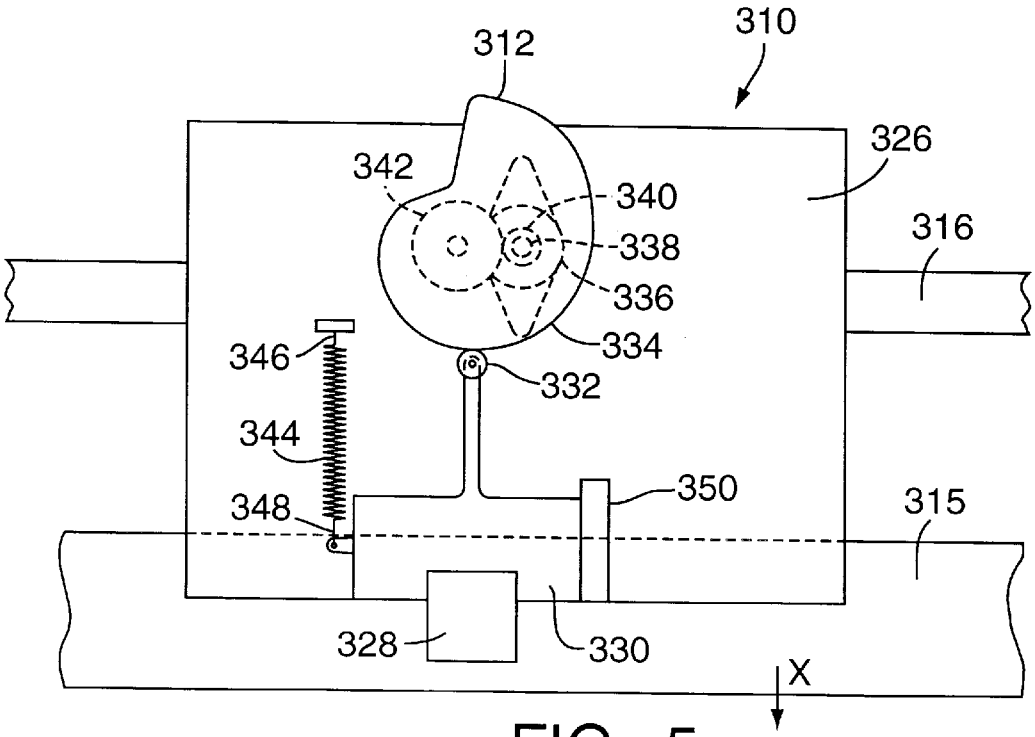
FIG. 5 is a partial view of another embodiment of the apparatus of FIG. 1 showing a cam actuated print head.

Yet another embodiment of the apparatus of the present invention is shown in FIG. 5 and is generally designated by the reference numeral 310. The apparatus 310 is similar in many respects to the apparatus 10 described above, and, therefore, like reference numerals preceded by the number 3 are used to indicate like elements. In this embodiment, the print head 328 is driven between the forward and rearward positions by a cam 312 rotatably mounted to a bracket 326. The bracket 326 is in turn mounted an elongated support 316 which moves the bracket transversely across a sheet of work material 315. The print head 328 is attached to a print head carrier 330 which is slidably mounted on the bracket 326 for movement between a forward and rearward position. The print head carrier 330 includes a cam follower 332 coupled for rotation thereto and in engagement with a periphery 334 defined by the cam. The cam is driven by a suitable means such as a stepper motor 336 (shown in dotted line) having a rotatable shaft 338 extending therefrom and a pinion 340 mounted thereto and engaging a gear 342 which drives the cam 312. A spring 344 is attached at one end 346 to bracket 326 and at an opposite end 348 to the print head carrier 330. A guide member 350 is also mounted to the bracket 326 for directing the motion of the print head carrier 330 between its forward and rearward position.

During operation, as the bracket 326 traverses the sheet material 315 which in turn is continuously moving in a direction longitudinal of itself as indicated by the arrow labeled X, the cam 312 is rotated via stepper motor 336 causing the print head 328 to move between the forward and rearward position in response to commands issued from a controller. The cam is configured, and the stepper motor rotated at such a rate as to impart a component of velocity in the direction indicated by the arrow X that is equal to the rate at which the sheet material 315 is advanced. When the print head 328 has traversed the sheet material 315, the spring 344 then acts to return the print head 328 to the rearward position thereby allowing the next line to be printed. In this manner, lineal portions of a graphic perpendicular to the direction of motion of the sheet material are consecutively printed until the desired graphic is transferred to the sheet material.

While preferred embodiments have been shown and described, various modifications and substitutions may be made without departing from the spirit and scope of the present invention. Accordingly, it is to be understood that the present invention has been described by way of example, and not by limitation.

What is claimed is:

1. An apparatus for printing on a continuously moving sheet of work material, comprising:

a frame defining a work supporting surface;

means for continuously advancing a sheet of work material in a first coordinate direction longitudinal of itself at a known rate, over said work supporting surface;

an elongated support having first and second ends, coupled to said frame and extending transversely across, and adjacent to said work supporting surface;

at least one print head coupled to said support for movement between said first and second ends;

means for selectively and continuously moving said print head across said elongated support between said first and second ends;

means for progressively moving said print head between a forward and rearward position in a direction approximately parallel to said first coordinate direction, as said print head moves between said first and second ends, such that the motion of the print head has a component of velocity in the first coordinate direction, approximately equal to the rate at which the work material is advanced;

a controller for issuing commands to said apparatus in accordance with machine readable data stored in said controller corresponding to a graphic to be printed, said commands controlling the positional relationship of said print head relative to said support and said work material, such that the combined motion of said print head and said work material causes said print head to print successive lineal portions of said graphic having a width and oriented approximately perpendicular to the first coordinate direction.

2. An apparatus for printing on a continuously moving sheet of work material as defined by claim 1, wherein:

said print head includes a plurality of spaced apart rows of discrete print elements arranged in a matrix-like array defining a height;

each of said print elements for printing pixels of a given height, on said work material;

said means for progressively moving said print head between a forward and rearward position causes said print head, upon reaching each of said first and second ends of said support, to move, in an amount approximately equal to said width of said lineal portion in a direction approximately opposite to said first coordinate direction, less the distance advanced by said work material while said print head is moving.

3. An apparatus for printing on a continuously moving sheet of work material as defined by claim 1, wherein said means for selectively and continuously moving said print head across said elongated support includes:

a pair of spaced apart sprockets one of which is rotatably coupled to the support at each of said first and second ends;

a belt mounted for rotation on said pair of sprockets;

means for driving at least one of said sprockets and thereby said belt, in response to commands issued from said controller; and wherein said print head is coupled to said belt and traverses said work material between said first and second ends.

4. An apparatus for printing on a continuously moving sheet of work material as defined by claim 1, wherein said means for progressively moving said print head between said forward and rearward position includes:

a mounting bracket coupled to said support;

said print head being slidably coupled to said mounting bracket; and an actuator coupled to said mounting bracket, and engaged with said print head for moving said print between said forward and rearward positions in response to commands issued from said controller.

5. An apparatus for printing on a continuously moving sheet of work material as defined by claim 1, wherein said means for selectively and continuously moving said print head across said elongated support includes:

a pair of spaced apart sprockets, each sprocket being rotatably coupled to the support at said first and second ends respectively;

a belt mounted for rotation on said pair of sprockets;

means for driving at least one of said sprockets and thereby said belt, in response to commands issued from said controller; and wherein said print head is coupled to said belt and traverses said work material between said first and second ends.

6. An apparatus for printing on a continuously moving sheet of work material as defined by claim 4, wherein said actuator is a servo.

7. An apparatus for printing on a continuously moving sheet of work material as defined by claim 4, wherein said actuator includes a mechanical cam.

8. An apparatus for printing on a continuously moving sheet of work material as defined by claim 1, wherein:

said support is pivotally coupled to said frame for movement between a first and second angle; and wherein said print head is slidably coupled to said support for movement transversely across said work material from said first to said second end when said support is oriented along said first angle, and in from said second to said first end when said support is oriented along said second angle.

9. An apparatus for printing on a continuously moving sheet of work material as defined by claim 1, wherein:

said elongated support includes an approximately figure-8-shaped path coupled to the support and having a first segment extending transversely across said work material and oriented at a first angle, and a second segment extending transversely across said work material and oriented at a second angle, said second angle being approximately equal and opposite to said first angle, said second segment crossing said first segment at a point approximately midway across said work material; and said print head is slidably coupled to said path and continuously traces said figure-8-shaped path as said sheet material is continuously advanced in said first coordinate direction.

10. An apparatus for printing on a continuously moving sheet of work material as defined by claim 1, further comprising:

a plurality of print heads slidably coupled to said elongated support, each print head being spaced a known distance away, and offset from the next successive print head, for printing several lines of said graphic each time said print head moves between said first and second ends.

11. An apparatus for printing on a continuously moving sheet of work material as defined by claim 1 wherein said at least one print head is an inkjet print head.

12. An apparatus for printing on a continuously moving sheet of work material as defined by claim 1 wherein said at least one print head is a thermal print head.

13. An apparatus for printing on a continuously moving sheet of work material as defined by claim 1 wherein said at least one print head is dot matrix print head.

14. An apparatus for printing on a continuously moving sheet of work material as defined by claim 1, wherein the work supporting surface is substantially flat.

15. An apparatus for printing on a continuously moving sheet of work material as defined by claim 1, wherein the work supporting surface is substantially cylindrical.

16. A method for printing on a continuously moving sheet of work material, comprising the steps of:

(a). providing a printing apparatus having a frame defining a work supporting surface, means for continuously moving a sheet of work material at a known rate in a first coordinate direction longitudinal of itself, over said work supporting surface, an elongated support having first and second ends, coupled to said frame and extending transversely across, and adjacent to said work supporting surface, at least one print head movably coupled to said elongated support and defining a plurality of spaced-apart rows of discrete print elements arranged in a matrix-like array, means for selectively and continuously moving said print head across said elongated support between said first and second ends, means for progressively moving said print head between a forward and rearward position in a direction approximately perpendicular to said support, as said print head moves between said first and second ends, and a controller for issuing commands to said apparatus in accordance with machine readable data stored in said controller corresponding to a graphic to be printed;

(b). providing a sheet-type work material;

(c). advancing said work material through said apparatus in said first coordinate direction;

(d). moving said print head across said elongated support between said first and second ends at a first rate, while simultaneously moving said print head between said forward and rearward positions at a second rate, such that the movement of the print head has a component of velocity in the first coordinate direction approximately equal to the rate at which the work material is advanced through the apparatus;

(e). printing a lineal portion having a known width, of a graphic onto said work material along a line approximately perpendicular to said first coordinate direction in response to commands issued from the controller corresponding to graphical data stored therein;

(f). moving said print head, upon reaching each of the first and second ends in a direction approximately opposite to said first coordinate direction, a distance equal to the width of the lineal portion less a distance advanced by said work material which said print head is moving.

(g). repeating steps (b)–(f) until a desired graphic is printed on said work material.

17. A method for printing on a continuously moving sheet of work material as defined by claim 16, wherein:

said printing apparatus includes a feedback sensor for sensing the rate at which the work material is advanced; and wherein said method further includes the steps of sensing the rate at which the work material is advanced using said feedback sensor;

sending a signal from said feedback sensor to said controller; and adjusting the rate at which the print head prints onto said work material in response to commands issued from the controller, to compensate for variations in the speed at which the work material is advanced.

18. A method for printing on a continuously moving sheet of work material as defined by claim 16, wherein:

said sheet of work material extends part-way across said work supporting surface; and wherein said step of moving said print head includes moving said print head across said work material and part-way across said elongated support.

19. A method for printing on a continuously moving sheet of work material as defined by claim 16, wherein:

said printing apparatus includes a feedback sensor for sensing the rate at which the work material is advanced; and wherein said method further includes the steps of sensing the rate at which the work material is advanced using said feedback sensor;

sending a signal from said feedback sensor to said controller; and adjusting the rate at which the print head is moved across the elongated support, in response to commands issued from the controller, to compensate for variations in the speed at which the work material is advanced.

20. A method for printing on a continuously moving sheet of work material as defined by claim 16, further including the step of:

adjusting the rate at which the work material is advanced, in response to commands issued from the controller to compensate for any delays in issuing commands to the print head.

* * * * *